US008118116B2

(12) United States Patent
Lindèn

(10) Patent No.: US 8,118,116 B2
(45) Date of Patent: Feb. 21, 2012

(54) ELONGATED PERCUSSIVE ROCK DRILLING ELEMENT, A METHOD FOR PRODUCTION THEREOF AND A USE THEREOF

(75) Inventor: Johan Lindèn, Gävle (SE)

(73) Assignee: Sandvik Intellectual Property AB, Sandviken (SE)

( * ) Notice: Subject to any disclaimer, the term of this patent is extended or adjusted under 35 U.S.C. 154(b) by 638 days.

(21) Appl. No.: 12/216,776

(22) Filed: Jul. 10, 2008

(65) Prior Publication Data

US 2009/0013831 A1 Jan. 15, 2009

(30) Foreign Application Priority Data

Jul. 11, 2007 (SE) ..... 0701679

(51) Int. Cl.
*E21B 1/00* (2006.01)
*E21B 10/36* (2006.01)

(52) U.S. Cl. ..... 175/57; 175/320; 76/108.2; 148/325

(58) Field of Classification Search ..... 76/108.1, 76/108.2; 175/320, 57, 414; 148/325, 333, 148/334
See application file for complete search history.

(56) References Cited

U.S. PATENT DOCUMENTS

| | | | | |
|---|---|---|---|---|
| 2,676,820 | A * | 4/1954 | Boice | 285/114 |
| 3,138,216 | A * | 6/1964 | Heiskanen et al. | 175/320 |
| 3,709,306 | A * | 1/1973 | Curington | 173/132 |
| 4,386,458 | A * | 6/1983 | Evans | 29/527.7 |
| 4,919,728 | A | 4/1990 | Kohl et al. | |
| 6,547,891 | B2 | 4/2003 | Lindèn et al. | |
| 7,108,063 | B2 * | 9/2006 | Carstensen | 166/241.2 |
| 7,510,219 | B2 * | 3/2009 | Huston | 285/333 |
| 7,596,847 | B2 * | 10/2009 | Carstensen | 29/452 |

OTHER PUBLICATIONS

International Search Report mailed Oct. 21, 2008 issued in PCT Application No. PCT/SE2008/000411.

* cited by examiner

*Primary Examiner* — Nicole Coy
(74) *Attorney, Agent, or Firm* — Drinker Biddle & Reath LLP

(57) ABSTRACT

An elongated percussive rock drilling element comprises at least one thread portion and a flush channel. At least the thread portion is made of a corrosion resistant steel having a structure with a martensite content greater than about 50 wt-% and less than about 100 wt-%, in which the steel comprises C+N greater than about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu greater than about 0.5 wt-% or Cr+3.3 (Mo+W)+16N greater than about 10 wt-%. The surface of said at least one thread portion of said corrosion resistant steel is ball blasted.

13 Claims, 1 Drawing Sheet

ELONGATED PERCUSSIVE ROCK DRILLING ELEMENT, A METHOD FOR PRODUCTION THEREOF AND A USE THEREOF

CROSS-REFERENCE TO PRIOR APPLICATION

This application claims priority to Swedish Application No. 0701679-3 filed Jul. 11, 2007, which is incorporated by reference herein.

BACKGROUND OF THE INVENTION

The present invention relates to an elongated percussive rock drilling element comprising at least one thread portion and a flush channel.

During percussive rock drilling, shock waves and rotation are transferred from a drill machine via one or more elongated elements in the form of so-called drilling steels or drilling rods to a cemented carbide equipped drill bit. The percussion frequency is typically from about 50 to about 70 Hz. The material in such an element is subjected to corrosive attack during the drilling. This applies in particular to underground drilling where water is used as flushing medium supplied through the flush channel of the element and where the environment in general is humid. The corrosive attacks are especially serious in the most stressed parts, i.e., at the two ends of such an element, where the forces from the drill machine are directly or indirectly transferred to the element and from the element to the drill bit, respectively. In combination with pulsating stress, caused by bending stresses and the shock waves mentioned above, so-called corrosion fatigue arises, which means that cracks are created in the element through corrosion in combination with said stress, whereupon these propagate through the element until a rupture of the element occurs.

Accordingly, such a rupture normally occurs at the ends of the element, where mostly a thread portion is arranged for obtaining a power transmitting connection.

As a consequence of the above problem of corrosion fatigue, it has in U.S. Pat. No. 6,547,891 been suggested to make at least said thread portion of an element mentioned above of a corrosion resistant steel having a structure with a martensite content of greater than about 50 wt-% and less than about 100 wt-%, in which the steel comprises 0.1 wt-% less than or equal to about C+N less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu greater than about 0.5 wt-% or Cr+3.3 (Mo+W)+16N greater than about 10 wt-%.

Mechanical strength and core hardness required for the application of percussive rock drilling are obtained through the martensite structure of the matrix of the steel. However, the corrosion resistance is here of particular importance, which is obtained by the composition of the steel mentioned above and through which a passivation layer is formed on the surface, which prevents corrosion or reduces the corrosion rate and by that the corrosion fatigue. However such a drilling steel has a restricted life time in the form of the number of meters which may be drilled in a rock by this before it has to be rejected, which normally is necessary through a rupture in the region of a thread portion caused by mechanical fatigue.

This means that there is an ongoing attempt to prolong this life time by such means that results in a total saving of costs.

OBJECTS AND SUMMARY OF THE INVENTION

The object of the present invention is to provide an elongated percussive rock drilling element of the type defined above, which is modified with respect to such elements already known in a way being attractive from the costs point of view for obtaining a prolonged life time of the element.

In one aspect of the invention, there is provided an elongated percussive rock drilling element comprising at least one thread portion and a flush channel, at least said thread portion being made of a corrosion resistant steel having a structure with a martensite content of greater than about 50 wt-% and less than about 100 wt-%, in which the steel comprises C+N greater than about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu greater than about 0.5 wt-% or Cr+3.3 (Mo+W)+16N greater than about 10 wt-%, wherein the surface of said at least one thread portion of said corrosion resistant steel is ball blasted.

In another aspect of the invention, there is provided a method for producing an elongated percussive rock drilling element comprising at least one thread portion and a flush channel, at least said thread portion being made of a corrosion resistant steel having a structure with a martensite content greater than about 50 wt-% and less than about 100 wt-%, in which the steel comprises C+N greater than or equal to about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu greater than about 0.5 wt-% or Cr+3.3 (Mo+W)+16N greater than about 10 wt-%, comprising a final step of ball blasting of said at least one thread portion.

In yet another object of the invention, there is provided the use of an element as described above for percussive rock drilling.

BRIEF DESCRIPTION OF THE DRAWINGS

With reference to the appended drawing, below follows a description of an embodiment of the invention sited as an example. In the drawing.

DETAILED DESCRIPTION OF THE PREFERRED EMBODIMENTS

Figure 1:
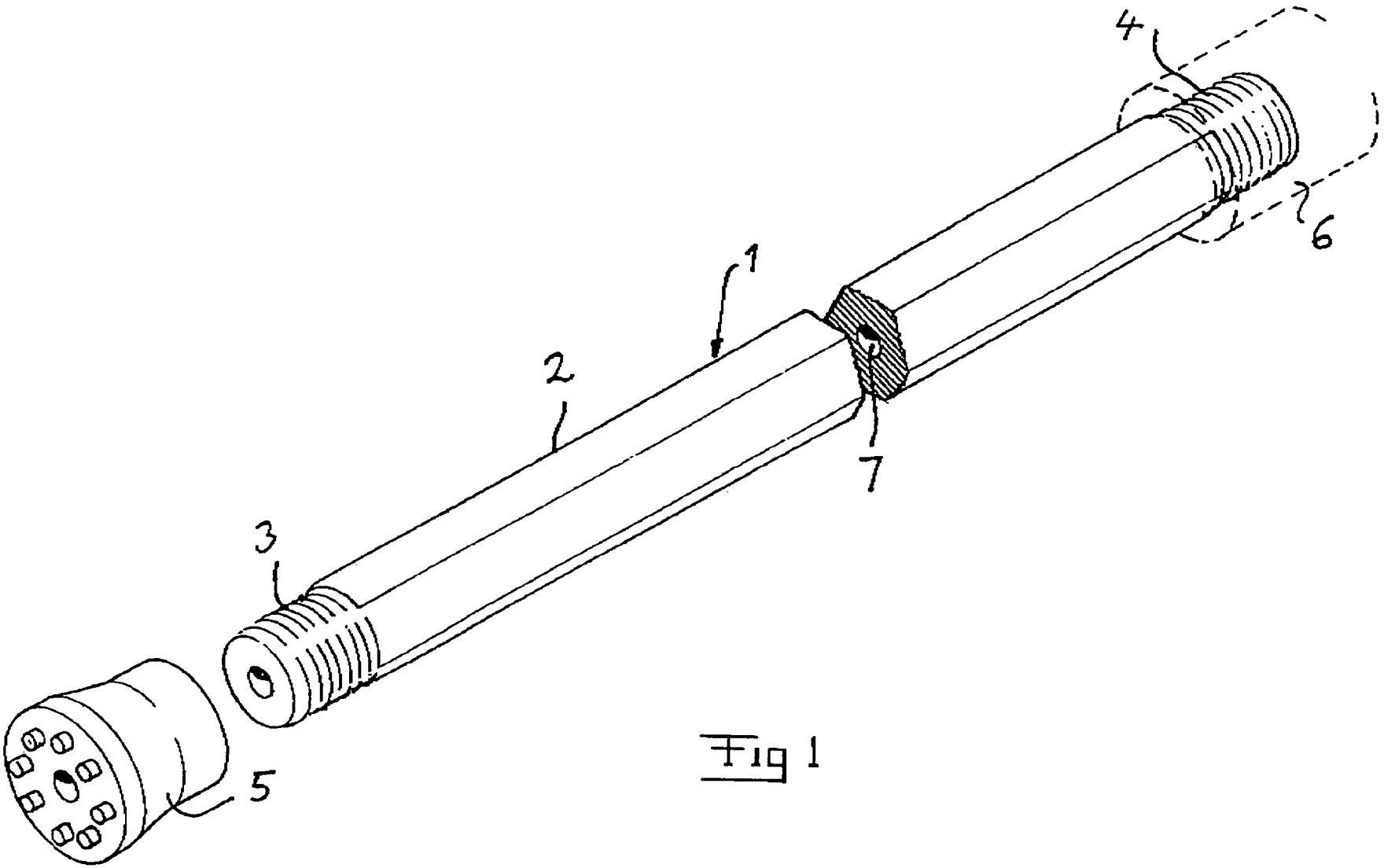
FIG. 1 is a schematic perspective view illustrating an elongated percussive rock drilling element according to the invention.

The above object is obtained by providing such an element, in which the surface of said at least one thread portion of said corrosion resistant steel is ball blasted.

It has in a very surprising way turned out that ball blasting of a corrosion resistant steel of this type has a dramatically positive influence upon the fatigue resistance of an elongated percussive rock drilling element. The ball blasting gives a much better end result with respect to stresses in the surface layer forming the ball blasted surface than when ball blasting carbon steels conventionally used for elements of this type and having a chromium content less than about 5%, such as Sanbar 64 and Sanbar 23 (trademarks belonging to Sandvik AB), in which through carburizing compressive stresses are present in said surface layer already before the ball blasting.

Thus, the combination of the use of a corrosion resistant steel for said thread portion in a elongated element and ball blasting of the surface of the thread portion, which had substantially no inherent compressive stresses before the ball blasting, has turned out to result in astonishing good properties with respect to fatigue resistance. More exactly, tests carried out has shown that the life time of such an element for percussive rock drilling may be prolonged by a factor in the order of 20 by performing said ball blasting. This means that the ball blasting of this type of material for a percussive rock drilling element constitutes an extremely attractive addition as a final operation when manufacturing such an element.

It has turned out that in such an element the compressive stresses introduced in said surface portion through the ball blasting gets so strong that the life time of such an element is normally not restricted by corrosion fatigue, but the threads of the thread portion are simply instead usually worn out before cracks created by cooperation of corrosion and pulsating stress have propagated through the material and caused a rupture.

According to an embodiment of the invention, the martensite content of the corrosion resistant steel is greater than about 75 wt-%. Such a high martensite content results in good resistance and core hardness of that part of the element which is made of this steel.

According to another embodiment of the invention the martensite content of the corrosion resistant steel is equal to or less than about 98 wt-%.

According to another embodiment of the invention the corrosion resistant steel comprises in wt-%:

C equals from about 0.15 to about 0.25
Cr equals from about 12.5 to about 14
Ni equals from about 0.2 to about 0.4
Mo equals from about 0.01 to about 0.03
W equals from about 0 to about 0.02
Cu equals from about 0.10 to about 0.15
N equals from about 0.010 to about 0.015 the balance being iron and normally occurring impurities, said martensite content being from about 96 to about 99 wt-%.

A steel with such a composition has turned out to result in a particularly much prolonged life time of an element for percussive rock drilling when combined with ball blasting thereof.

According to another embodiment of the invention, the corrosion resistant steel comprises in wt-%:

C equals about 0.18
Cr equals about 13.4
Ni equals about 0.3
Mo equals about 0.02
W equals about 0.01
Cu equals about 0.12
N equals about 0.012 the balance being iron and normally occurring impurities, said martensite content being about 98%.

It has turned out that an element with at least one said thread portion made of a corrosion resistant steel with this composition and a ball blasted surface has a life time being in the order of 20 times longer than for such an element without a ball blasted surface.

According to another embodiment of the invention, the element has a thread portion of corrosion resistant steel having a ball blasted surface at each end of the element. In the case of a power transmitting connection of the element obtained by a thread portion at each end of the element, it is from a fatigue resistance point of view advantageous to have both these thread portions made of corrosion resistant steel and with ball blasted surface.

According to another embodiment of the invention, substantially the entire elongated element is made of said corrosion resistant steel and has a ball blasted surface. The risk that corrosion fatigue after all could occur on other parts of the element than those most subjected to stress is by this minimized.

According to another embodiment of the invention, at least the surface of at least said thread portion is ball blasted at least twice. An increased compressive stress in the surface portion of said thread portion, i.e. where the stresses are highest, is obtained by carrying out such an extra ball blasting, which has a positive influence upon the life time of the element.

The invention also relates to a method for producing an elongated percussive rock drilling element according to the appended independent method claim, in which the final step comprises ball blasting a thread portion of such an element. The advantage of such a method appear from the description above.

The invention also relates to a use of an element according to the invention and/or an element produced according to the method according to the invention for percussive rock drilling, which means that the time periods between requirements to change such an element gets considerably longer and the drilling will by that be more efficient than when drilling by means of drilling steels already known.

An elongated percussive rock drilling element in the form of a so-called drilling steel or rod 1 of the type to which the present invention relates is schematically illustrated in FIG. 1. The drilling rod 1 has here a length of about 4.3 m and has an elongated mid portion 2 with a hexagonal cross-section with a thickness of 35 mm between opposite sides, and at each end a thread portion 3, 4 for connection with a button bit 5 schematically indicated, for example having an other diameter of 48 mm, and a driving arrangement 6 also schematically indicated of a drill machine for generating shock waves and rotation for percussive rock drilling. A flush channel 7 extends through the element 1 for flushing drill cuttings created when drilling away. Drilling by such a drilling rod normally results in ruptures as a consequence of corrosion fatigue in any of the thread portions 3, 4.

The entire elongated element 1 according to this embodiment of the invention is made of a corrosion resistant steel with a martensite content greater than about 50 wt-% and less than about 100 wt-%, in which the steel comprises C+N greater than about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about ≦2 wt-%, Mo+W+Cu greater than about 0.5 wt-% or Cr+3.3 (Mo+W)+16N greater than about 10 wt-%.

The production is performed by conventional rod manufacturing and machining. The steel is hardened and cold-worked for obtaining the desired martensite structure. A final operation of ball blasting is applied on the element by firstly ball blasting the entire outer surface of the element in one step, whereupon the two thread portions 3, 4 are subjected to an extra ball blasting step. It has turned out that the fatigue resistance of the element is very remarkably improved by this final operation of a ball blasting.

The invention is additionally illustrated in connection with the following examples, which are to be considered as illustrative of the present invention. It should be understood, however, that the invention is not limited to the specific details of the examples.

Production of Samples for Testing

An elongated element produced by conventional rod manufacturing and machining and having the dimensions mentioned above was produced out of a corrosion resistant steel with the following composition in wt-%:

C equals about 0.18
Cr equals about 13.4
Ni equals about 0.3
Mo equals about 0.02
W equals about 0.01
Cu equals about 0.12
N equals about 0.012 the balance being iron and normally occurring impurities, said martensite content being about 98%.

This element was then subjected to a ball blasting of the entire surface thereof with balls of a diameter of 1.0 mm and a hardness of the balls of 50-56 HRC. The ball blasting had a coverage >100% and was carried out with an intensity >50 Almen A2 at saturation.

An extra ball blasting of the two thread portions 3, 4 was then carried out with balls of a diameter of 1.0 mm and a hardness of the balls of 50-56 HRC. The coverage was >100%. The intensity of the ball blasting was >50 Almen C2 at saturation.

Test

The drill rods produced according to above was then subjected to tests by drilling with a button bit having a diameter of 48 mm into granite. The drilling was carried out until the respective drill rod failed by rupture or by having any of the thread portions worn out so that an appropriate power transmission from the driving arrangement to the drill rod or from the drill rod to the drill bit could not take place any longer. The total drilling length in meters until such a failure occurred was measured. A drilling length of 144 m means for example that it was possible to drill about 30 holes with the drilling rod before it failed.

The same test was carried out for the sake of comparison with drilling rods being identical except for the fact that they where not subjected to said final operation of ball blasting.

The results are indicated in the following Table 1.

TABLE 1

| | No. | Lifetime (m) |
|---|---|---|
| Comparing sample: | 1 | 144 |
| | 2 | 102 |
| | 3 | 70 |
| | 4 | 152 |
| | 5 | 44 |
| | Average | 102 |
| The invention | 11 | 919 |
| | 12 | 3105 |
| | 13 | 3602 |
| | 14 | 909 |
| | 15 | 3980 |
| | 16 | 1059 |
| | 17 | 2285 |
| | 18 | 394 |
| | Average | 2031 |

The drilling rods according to the comparison examples were all broken as a consequence of mechanical fatigue in any of the thread portions, while the rods according to the invention mainly failed by wearing any of the thread portions out, in which wearing out of the "neck thread" dominated.

This test shows in a very surprising way an increase of the fatigue resistance of the drilling rods according to the invention with respect to the drilling rods not subjected to any ball blasting by a factor of about 20, which is extremely remarkable. It is pointed out that the ball blasting is a comparatively simple operation which only takes in the order of minutes to carry out.

The ball blasting is advantageously carried out with balls having a diameter of from about 0.7 to about 1.3 mm, preferably about 1.0 mm, and a hardness of the balls of from about 50 to about 56 HRC. The ball blasting is advantageously carried out with a coverage of greater than about 100%. It is advantageously carried out with an intensity greater than about 50 Almen A2 at saturation with respect to the first step and an intensity of greater than about 50 Almen C2 at saturation with respect to the repeated ball blasting step. It is estimated that compressive residual stresses of about 100 to about 1500 MPa are by that obtained in a surface layer of from about 0.01 to about 0.5 mm thickness.

The invention if of course not in any way restricted to the embodiment described above, but many possibilities to modifications thereof would be apparent to a person with skill in the art without departing from the basic idea of the invention as defined in the appended claims.

It would, for example, be possible to have only one part of the element made of said corrosion resistant steel, so that for example the elongated mid portion could be made of a carbon steel and the thread portions could be friction welded to this mid portion.

It is also within the scope of the invention to have a thread portion only at one end of the element and to have the power transmitting connection obtained in another way at the other end, such as through a known cone connection.

It is also possible to ball blast only one or more said thread portions of the element and not the rest of the element. The thread portion could in such a case also be subjected to repeated ball blasting steps. It is also possible to subject the entire element to one single ball blasting step and refrain from the extra ball blasting of the thread portions in cases where this is considered to be suitable. Other sizes, materials and hardnesses of balls used for the ball blasting than those indicated above are conceivable. The same is valid for the intensity figures.

It has in a very surprising way turned out that ball blasting of exactly a corrosion resistant steel of this type has a dramatically positive influence upon the fatigue resistance of an elongated percussive rock drilling element. The increase of the lifetime obtained has been in a totally different order of magnitude than expected, so that ball blasting of exactly this type of material for a percussive rock drilling element constitutes an attractive supplement as final operation when manufacturing such an element.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. An elongated percussive rock drilling element comprising at least one thread portion and a flush channel, at least said thread portion being made of a corrosion resistant steel having a structure with a martensite content of greater than about 50 wt-% and less than about 100 wt-%, in which the steel comprises C+N greater than about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu>0.5 wt-% or Cr+3.3 (Mo+W)+16N greater than about 10 wt-%, wherein the surface of said at least one thread portion of said corrosion resistant steel is ball blasted.

2. An element of claim 1, wherein in that the martensite content of the corrosion resistant steels martensite content is greater than about 75 wt-% and in that compressive residual stresses are obtained in a surface layer of from about 0.01 to about 0.5 mm thickness.

3. An element of claim 1, wherein the martensite content of the corrosion resistant steel is less than or equal to about 98 wt-%.

4. An element of claim 1 wherein the corrosion resistant steel comprises in wt-%:

C equals from about 0.15 to about 0.25

Cr equals from about 12.5 to about 14

Ni equals from about 0.2 to about 0.4

Mo equals from about 0.01 to about 0.03

W equals from about 0 to about 0.02

Cu equals from about 0.10 to about 0.15

N equals from about 0.010 to about 0.015 the balance being iron and normally occurring impurities, said martensite content being from about 96 to about 99 wt-%.

5. An element of claim 4, wherein the corrosion resistant steel comprises in wt-%:

| | |
|---|---|
| C | 0.18 |
| Cr | 13.4 |
| Ni | 0.3 |
| Mo | 0.02 |
| W | 0.01 |
| Cu | 0.12 |
| N | 0.012 |

the balance being iron and normally occurring impurities, said martensite content being 98%.

6. An element of claim 1 wherein said thread portion of corrosion resistant steel being ball blasted with a ball blasted surface at each end of the element.

7. An element of claim 1 wherein substantially the entire elongated element is made of said corrosion resistant steel and has a ball blasted surface.

8. An element of claim 1 wherein at least the surface of at least said thread portion is ball blasted at least twice.

9. A method for producing an elongated percussive rock drilling element comprising at least one thread portion and a flush channel, at least said thread portion being made of a corrosion resistant steel having a structure with a martensite content greater than about 50 wt-% and less than about 100 wt-%, in which the steel comprises C+N greater than about 0.1 wt-% and less than or equal to about 0.8 wt-% and Cr greater than or equal to about 11 wt-% or Cr greater than or equal to about 5 wt-%, Mo less than or equal to about 5 wt-%, W less than or equal to about 5 wt-%, Cu less than or equal to about 2 wt-%, Mo+W+Cu greater than about 0.5 wt-% or Cr+3.3 (Mo+W)+16N greater than about 10 wt-%, comprising a final step of ball blasting of said at least one thread portion.

10. A method according to claim 9, wherein it is an element having thread portions at both ends thereof that is produced, and that the ball blasting step is carried out on both said thread portions and such that compressive residual stresses are obtained in a surface layer of from about 0.01 to about 0.5 mm thickness.

11. A method of claim 9 wherein which substantially the entire element is made of said corrosion resistant steel and said step of ball blasting is carried out on substantially the entire element.

12. A method of claim 9 wherein said step of ball blasting of said thread portion is repeated at least once.

13. A method of using the element defined by claim 1 for percussive rock drilling, comprising contacting a rock formation with the element and transferring a shock wave and a rotation to the element from a drill machine.

* * * * *